US009776791B2

(12) United States Patent
Altobelli

(10) Patent No.: US 9,776,791 B2
(45) Date of Patent: Oct. 3, 2017

(54) SUPPORTING STRUCTURE FOR A CONTAINER CARGO

(71) Applicant: ECEPLAST S.R.L., Bitonto (BA) (IT)

(72) Inventor: Giuseppe Altobelli, Troia (IT)

(73) Assignee: ECEPLAST, S.R.L., Troia (FG) (IT)

( * ) Notice: Subject to any disclaimer, the term of this patent is extended or adjusted under 35 U.S.C. 154(b) by 0 days.

(21) Appl. No.: 15/128,525

(22) PCT Filed: Apr. 4, 2014

(86) PCT No.: PCT/IT2014/000099
§ 371 (c)(1),
(2) Date: Sep. 23, 2016

(87) PCT Pub. No.: WO2015/151124
PCT Pub. Date: Oct. 8, 2015

(65) Prior Publication Data
US 2017/0107051 A1 Apr. 20, 2017

(51) Int. Cl.
*B65D 3/30* (2006.01)
*B65D 90/04* (2006.01)

(52) U.S. Cl.
CPC ..... *B65D 90/048* (2013.01)

(58) Field of Classification Search
CPC ..... B65D 2590/046; B65D 90/048; B65D 90/046; B64D 9/00
See application file for complete search history.

(56) References Cited

U.S. PATENT DOCUMENTS 3,204,581 A * 9/1965 Davidson ..... B60P 1/36 410/79
4,601,405 A 7/1986 Riemer
5,188,460 A * 2/1993 Dorse ..... B65D 88/22 220/495.06
5,551,379 A 9/1996 Hart
5,657,896 A * 8/1997 Matias ..... B65D 90/048 220/1.6
5,667,002 A * 9/1997 Neustadt ..... B65D 88/14 160/368.1
6,435,786 B1 * 8/2002 Breckel ..... B64D 9/00 410/118
7,516,863 B2 * 4/2009 Siegers ..... B65D 90/048 220/1.6
2003/0047561 A1 3/2003 Neto
2007/0267410 A1 * 11/2007 Mino ..... B65D 90/048 220/1.6
2008/0203229 A1 * 8/2008 Herbst ..... B64D 9/00 244/129.1
2009/0277900 A1 * 11/2009 Howison ..... B65D 90/0033 220/1.6
2014/0301669 A1 * 10/2014 Baeck ..... B63B 35/285 383/3

* cited by examiner

*Primary Examiner* — Bradley Duckworth
(74) *Attorney, Agent, or Firm* — R. Ruschena Patent Agent, LLC

(57) ABSTRACT

A cargo supporting structure made of a liner, mounted inside a container cargo, comprising a plurality of pre-tensioned belts coupled to an elastically deformable and not extensible element shaped like a circular ring, made of composite material and reinforced with steel stiffening elements; and comprising one ratchet tensioning means, mounted on one of the pre-tensioned belts to tension all pre-tensioned belts.

5 Claims, 3 Drawing Sheets

SUPPORTING STRUCTURE FOR A CONTAINER CARGO

BACKGROUND OF THE INVENTION

1. Field of the Invention

The present invention relates to a novel supporting structure for a container cargo mounted from its open side, to be used especially when the cargo is made up of bulk material to be contained inside a liner, i.e. a wrapping plastic material arranged inside the same container. The supporting structure of the liner is made up of multiple pre-tensioned belts coupled to an elastically deformable element arranged in the center and made up of a composite material.

2. Brief Description of the Prior Art

It is known in fact that for the transportation of bulk granulated materials inside a container it is indispensable to use the so called "liners" i.e. wrappings made of plastic material of great dimensions (nearly the size of a whole container) which have the function to contain the bulk material to be transported, similarly to a plastic bag of great dimensions.

It is also known that inserted through the open side of the container, a cargo supporting structure needs to guarantee structural resistance in the configuration inside of the cargo container in horizontal position and in the discharge configuration in which the container is lifted and inclined so that the bulk material is discharged from the open side of the container.

According to the state of the art, it is known that the above cited cargo supporting structures are usually made of a plurality of steel bars anchored to a stiffening wall equipped with suitable slots. The main disadvantage of this solution is in that said steel bars are intended to be disposable with the liner inside the container; in fact the production costs for the steel bars are substantial and are passed to the final customer, therefore it would be extremely advantageous to find an alternative way to avoid the increase in costs for the final customer.

It is also known the US patent application US2007267410 of Mino which discloses an outer stiffening system with belts applicable to a cargo to be transported inside a container. This system comprises a plurality of belts arranged in vertical (or horizontal) direction and spaced horizontally (or vertically) with respect to each other, the tension of each belt being adjustable independently. These belts are anchored by means of ring fasteners or by means of buckle fastening means and these fastening means are, in turn, coupled to another belt to be arranged inside the container at a prefixed distance from the open side of the same container.

This supporting system consists of too many parts and is complex and has many drawbacks. First of all, its applicability is strongly limited because of the complexity of the mounting procedure when the many belts to support the cargo need to be adjusted, and when each belt has to be tensioned to guarantee the perfect structural stability. This solution, requires an operator to manually intervene on many tensioning means which act on the belts, thus causing a huge waste of time by the personnel needed to complete the operation.

SUMMARY OF THE INVENTION

Therefore, aim of the present invention is to overcome all previously described drawbacks and to provide a cargo supporting structure (as for example a liner for the transport of bulk material) which is very simple to be made, and, at the same time, is very efficient from a structural point of view.

Another aim of the present invention is to optimize the mounting steps of the supporting structure, with particular attention to the tensioning of the whole supporting structure which is done by acting on only one tensioning means mounted on any belt the supporting structure is provided with.

The aims of the invention are solved by providing the use of reciprocal coupling between a plurality of pre-tensioned belts and a deformable, not extensible element, made of composite material to which all the belts are connected.

BRIEF DESCRIPTION OF THE DRAWINGS

These and other advantages will be clear from the detailed description of the present invention which will refer to FIGS. 1/3 to 3/3 in which it is shown an absolutely, not limiting, preferred embodiment of the invention. In particular.

DETAILED DESCRIPTION OF THE PREFERRED EMBODIMENTS

Referring to the figures, it will be described in detail a preferred embodiment of the present invention, in a not limiting way, using, as an example, a liner containing a bulk material to be transported inside a cargo container of standard dimensions.

Figure 1:
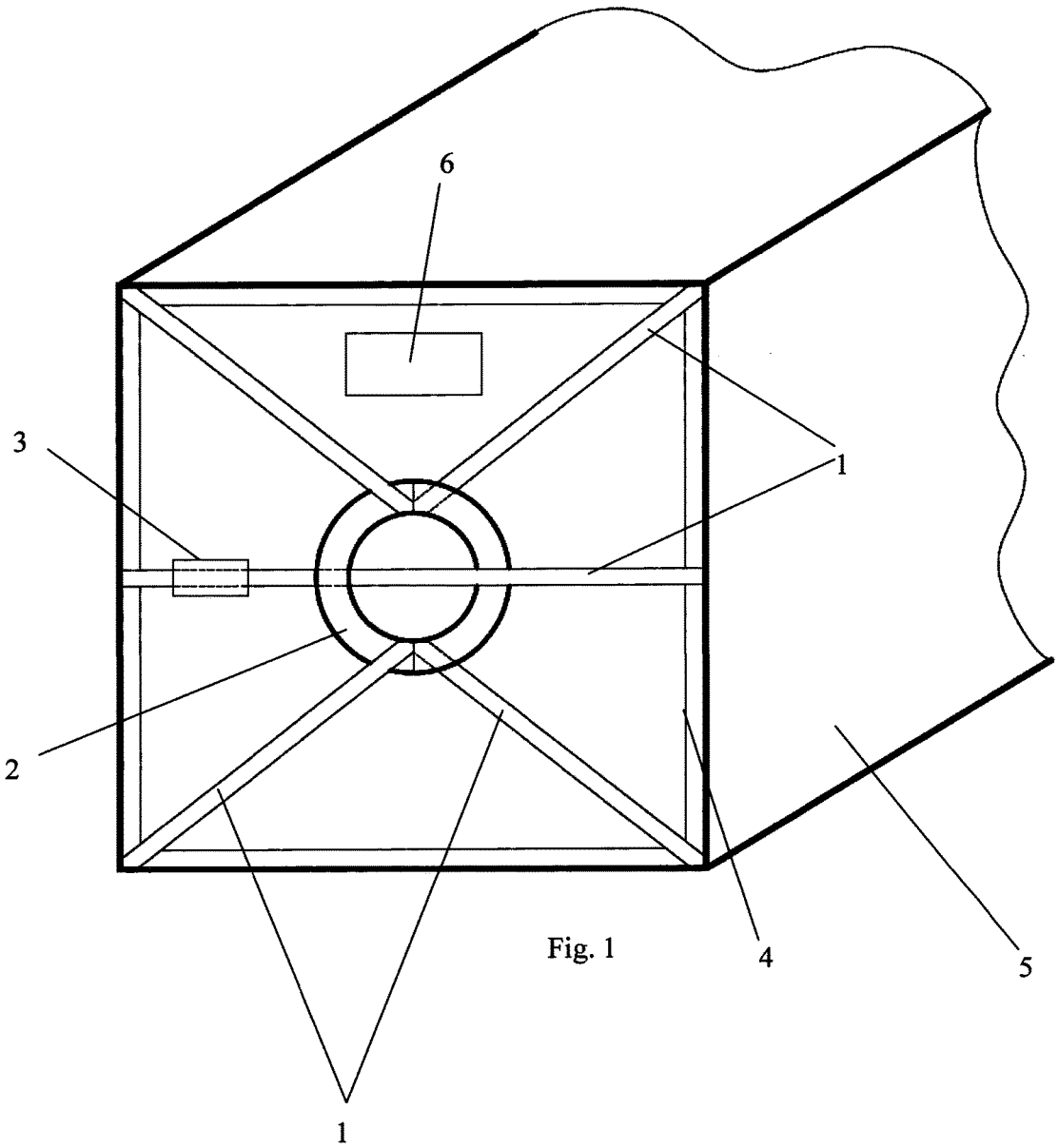
FIG. 1 shows the cargo supporting structure as inserted through the rear open side of a generic cargo container.

On FIG. 1 is described schematically the open side of a container 5 of standard dimensions ISO 20 ft or ISO 40 ft (i.e. containers of twenty or forty feet in length) with the cargo supporting structure, object of the present invention; in particular, the cargo to be transported is inside a liner 4 designed for the transport of bulk material. The supporting structure for the liner is made up of a plurality of pre-tensioned belts 1, a deformable, not extensible element 2 made of composite material, positioned in the center and at least a tensioning means 3 for adjusting the tension of the belts 1. The liner 4 inside the container is provided with at least an opening 6 through which the bulk material can be introduced or extracted from the liner. In the preferred embodiment of the cargo supporting structure shown on FIG. 1, the deformable element 2 is shaped as a circular ring 2 around which the belts 1 pass though, and is slightly deformed when is under the belts tension. However, at the same time, the ring 2 cannot be elastically extended since has inside with stiffening steel wires.

The liner 4 to be supported, usually has more or less standardized dimensions as it needs has to be inserted inside the container 5, filling up almost entirely its inner volume.

Figure 2:
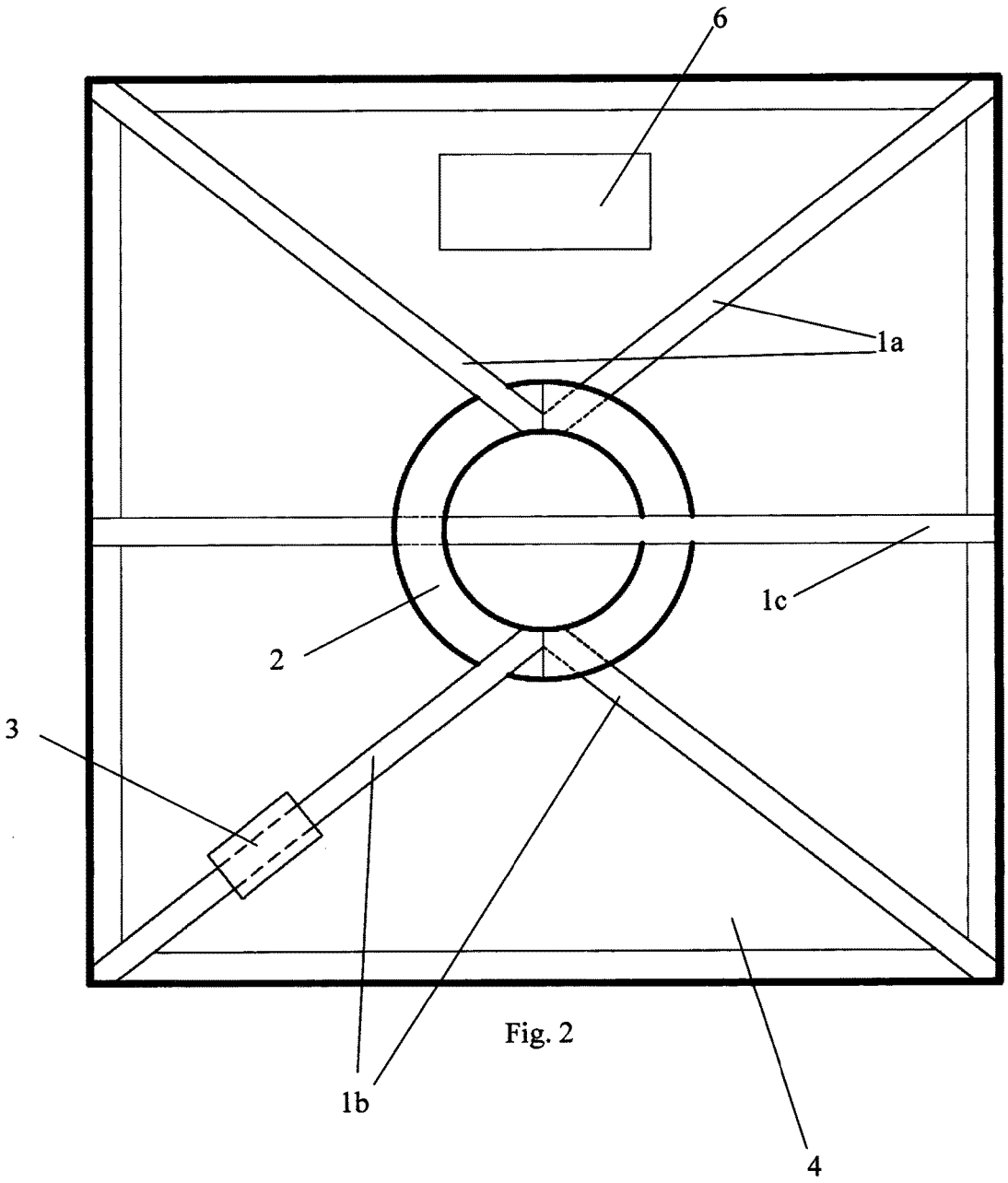
FIG. 2 is a front view of the open side of a container showing the cargo supporting structure made up of all belts coupled to a deformable, not extensible, central element.

As it is shown on the front view of FIG. 2, the pre-tensioned belts 1 are anchored on both ends to different connection points (preferably opposed with respect to each other) on the inner walls of the container 5, insuring that each belt 1 abuts in its way the central ring 2 thus acting as a support for the same ring 2. As it is clear from FIG. 2, the ring 2 maintains itself in an almost central position thanks to the combined actions of the belts 1, after being tensioned. Always referring to the preferred embodiment on FIG. 2, it is clear that a first belt 1*a* starts from the top right-hand side of the container, goes through the ring 2 at its upper portion and comes out from the other side of ring 2 to be attached to the upper end of the container, opposed to the starting point, on the top left-side of the container. A similar procedure can be adopted to position a second belt 1*b* in a specular way with respect to the belt 1*a* in the lower portion of the liner 4. A third belt 1*c* can be positioned horizontally almost at half height of the container and can be coupled to the opposed end insuring that it goes first through the inside of ring 2 and then to the outside of the ring 2 arranged in the center. It is also possible that the single belts 1 can go around the ring 2 multiple times to be optimally anchored. According to an alternative embodiment the cargo supporting structure, the third belt 1*c* can be substituted by a couple of belts (not represented on the drawings) to be arranged, always horizontally, each one with an end anchored to the inner wall of the container (right side and left side) and the other end to the central ring 2. The cargo supporting structure thus obtained by the coupling of the belts and the central ring, being tensioned by acting on only one tensioning means 3 mounted on any belt 1. Said tensioning means 3 is preferably positioned at a relatively low height with respect to the floor of the container 5, mounted one of the belts positioned in the lower portion of the liner 4. Said tensioning means 3 can consist of ratchet levers.

The tensioning means 3 allows to adjust the tension from only one point of the cargo supporting structure and to balance the whole structure, transferring uniformly the tension to all the belts.

Figure 3:
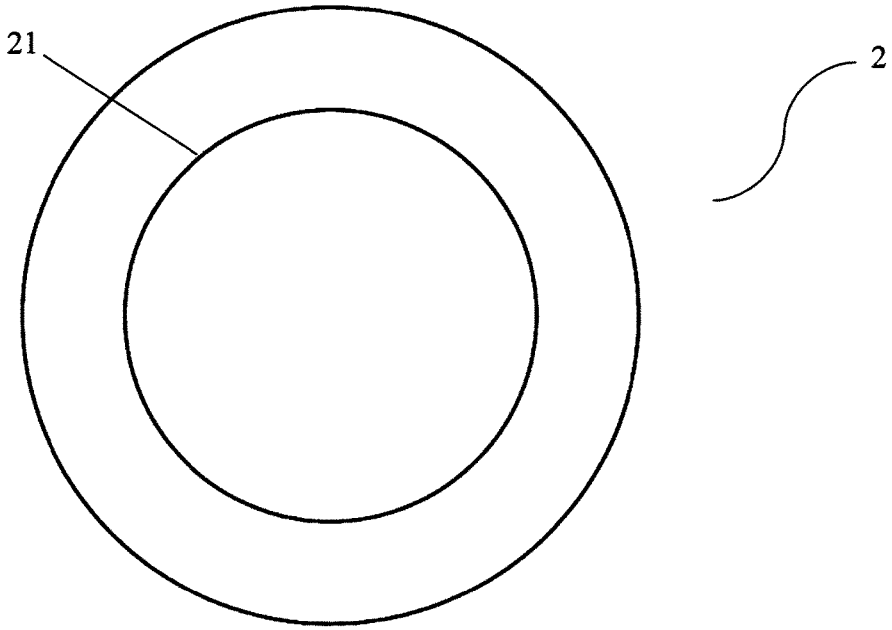
FIG. 3 shows a detail of the deformable, not extensible element in its preferred embodiment, shaped as a ring.

The central ring 2, as depicted on FIG. 3, is made up of a composite material consisting of a matrix of elastomer reinforced with a material which provides more stiffness. The elastomer can be usually made of cured rubber while the stiffening can be a steel ring arranged along the inner circumference 21 of the ring 2 or, alternatively, the stiffening can be provided by a plurality of steel wires arranged inside the rubber matrix. It is clear that also other materials can be used, provided that some elasticity and sufficient stiffness are maintained, to avoid deformation, as a purely elastic element 2 would.

Figure 4:
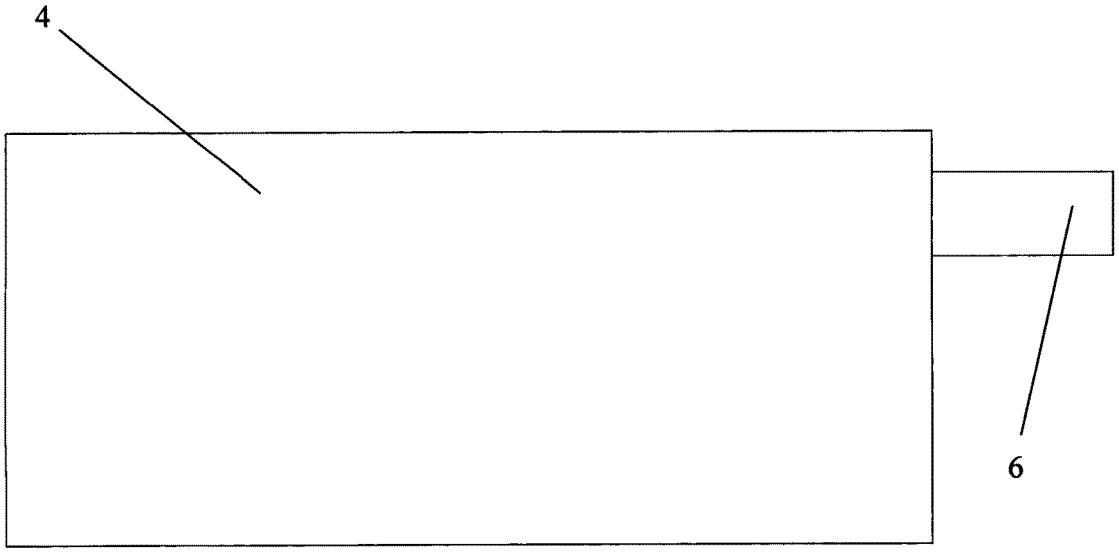
FIG. 4 shows a side view of the liner arranged inside the container for the transport of bulk materials, supported by the structure, object of the invention.

Finally, FIG. 4 shows schematically the liner 4, to be arranged inside the container 5, the liner being made of low density polyethylene having an average thickness of about 0.14 mm. As it is shown on the side view, the liner 4 can be provided with one or more openings 6 for the introduction and extraction of the bulk material to be transported.

In addition to the cargo supporting structure of a container as previously described, a raffia cloth (not represented for drawing simplicity) can be interposed between the structure made up of the belts 1 coupled to the central ring 2 and the liner 4 to be supported. The aim use of this cloth is to provide a clear separation between the bulk material contained inside the liner 4 and the cargo supporting structure.

The invention claimed is:

1. A cargo supporting structure (4) mounted inside a cargo container (5) by way of a container opening side, said cargo supporting structure (4) comprises a plurality of pre-tensioned belts (1), at least a deformable and not extensible element (2) having a center hole, and at least one tensioning means (3); wherein said cargo supporting structure (4) comprises connections between said belts (1) and said deformable and not extensible element (2) to which all said pre-tensioned belts (1) are connected; and wherein said deformable and not extensible element (2) is shaped as a circular ring and it is made up of a matrix of an elastomer with steel stiffening elements therein;

and wherein said connection between said pre-tensioned belts (1) and said deformable, not extensible element (2) is made by all belts passing through said center hole of the deformable and not extensible element (2).

2. The cargo supporting structure (4) mounted inside a container (5) according to claim 1, wherein said one tensioning means (3) is configured to tension the plurality of all pre-tensioned belts (1) of said supporting structure (4) is provided with.

3. The cargo supporting structure (4) mounted inside a container (5) according to claim 1, wherein said steel stiffening elements are arranged along an inner circumference (21) of the circular ring (2).

4. The cargo supporting structure (4) mounted inside a container (5) according to claim 1, wherein said tensioning means (3) are ratchet levers.

5. The cargo supporting structure (4) mounted inside a container (5) according to claim 1, wherein said cargo supporting structure (4) is a liner to contain bulk material to be transported.

* * * * *